United States Patent [19]

Seidman

[11] Patent Number: 4,548,411

[45] Date of Patent: Oct. 22, 1985

[54] PUZZLE TOY

[76] Inventor: Abraham Seidman, 10 Barzilai St., Holon, Israel

[21] Appl. No.: 613,584

[22] Filed: May 23, 1984

[30] Foreign Application Priority Data

Jun. 20, 1983 [IL] Israel ..... 69032

[51] Int. Cl.[4] ..... A63F 9/08

[52] U.S. Cl. ..... 273/153 R; 273/155

[58] Field of Search ..... 273/153 R, 153 S, 155

[56] References Cited

FOREIGN PATENT DOCUMENTS 2076663 12/1981 United Kingdom ..... 273/153 S

*Primary Examiner*—Anton O. Oechsle

*Attorney, Agent, or Firm*—Toren, McGeady, Stanger

[57] ABSTRACT

A puzzle comprising a casing in which fixed seats are provided for a like number of bodies. Each of the bodies is movable within its seat by being turned about two of its axes. The bodies are shaped like cubes with rounded edges and corners and with recesses in all six faces. Adjacent bodies are interconnected by cross shaped connectors having bulbous end portions at the free ends of the cross arms. The bulbous end portions matingly engage the recesses of the bodies. The faces of the cube are marked such as by colors or stripes and the object of the puzzle is to achieve selected arrangements of the markings.

4 Claims, 8 Drawing Figures

PUZZLE TOY

BACKGROUND AND FIELD OF INVENTION

This invention relates to a plaything of the type at which a kind of puzzle is put to a player who is expected to find a solution, possibly one of several possibilities. There are known a great number of such toys, the most famous being probably the one sold under the registered trademark Rubik's Cube.

In the present case a player has to arrange a number of bodies held movably in a casing and being arranged in rows and/or columns, to form a certain pattern wherein all bodies are given certain predeterminable positions within their places.

SHORT SUMMARY OF DISCLOSURE

According to the invention the new plaything comprises a casing in which fixed seats are provided for a multiple number of bodies, each of which is movable within its seat by being turned about two of its axes, the said bodies having the shape of cubes with rounded edges and rounded corners, recesses having been made in all six faces of each of said bodies, vicinal bodies being interconnected by cross shaped connectors which have bulbous end portions at the free ends of the cross arms, the said bulbous end portions extending matingly into the said recesses of the said bodies.

SHORT DESCRIPTION OF DRAWING

The invention will now be described with reference to the accompanying drawings in which:

FIG. 1 is a perspective view of the new toy partly shown in cut away positions.

FIG. 2 being a section on line II—II of FIG. 1.

FIGS. *3a–3f* show six different pattern arrangements.

DETAILED DESCRIPTION OF PREFERRED EMBODIMENT

Figure 2:
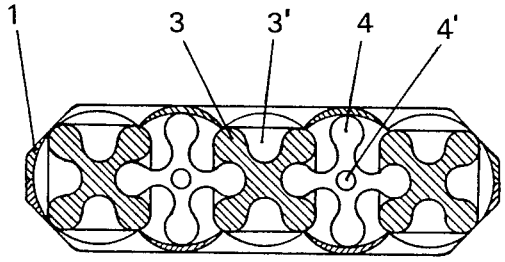
Figure 3:
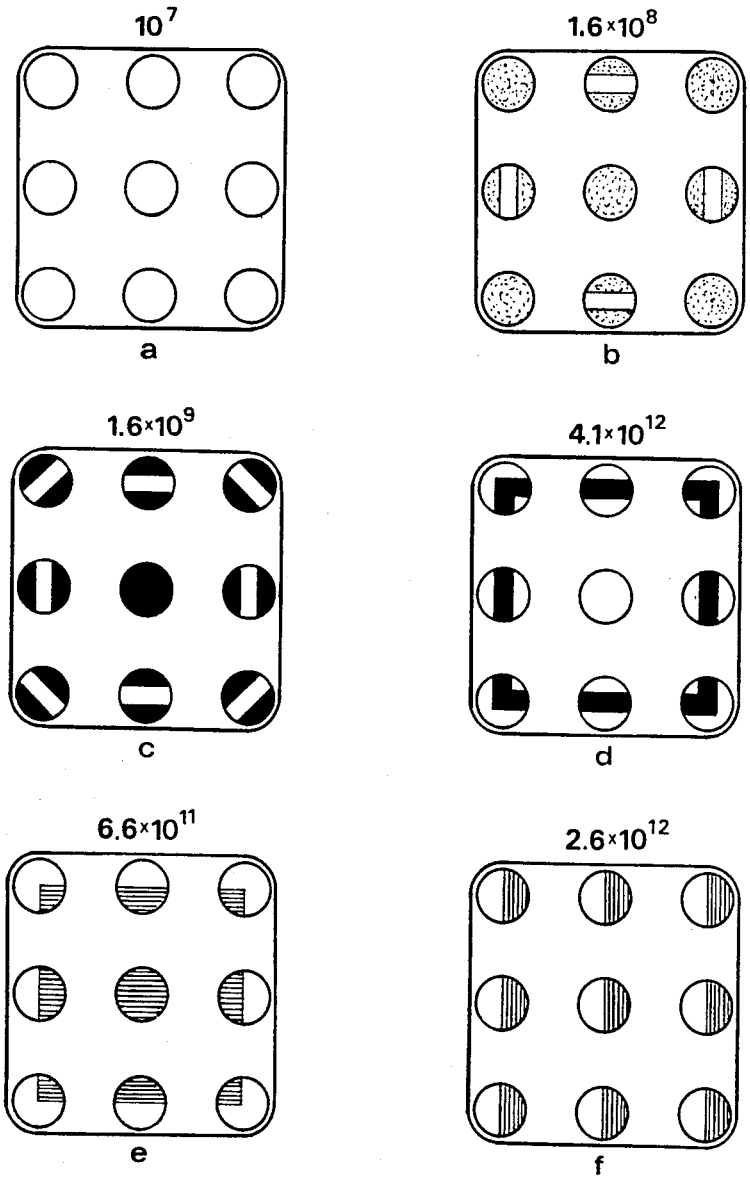

The casing 1 is composed of two plate shaped parts, as indicated in the drawing, wich are fixedlfy joined together, so that the casing as a whole may be considered one integral body. In the casing are provided seats 2 in which are turnably held bodies 3. As can be seen, the seats are positioned to form regular, straight rows or columns. Both sides of casing 1 are provided with openings 2' through which bodies 3 can be seen and can be turned by hand. The bodies 3 are in the shape of tubes, the edges and corners of which have been rounded. The bodies 3 have recesses 3' in every one of their six faces. Accordingly the cross sectional area of such a body is—as shown at the position X—cross shaped with bulbous end portions at the free ends of the cross arms. Similarly shaped are connectors 4 which each form a cross having bulbous end portions at the free ends of the cross arms as can be seen in FIG. 2. Each of the connectors 4 has a hub 4' about which it can turn. The bulbous end portions of each connector 4 enter matingly one of the recesses 3' of a body 3 and constitute a turning axis for bodies 3.

Figure 1:
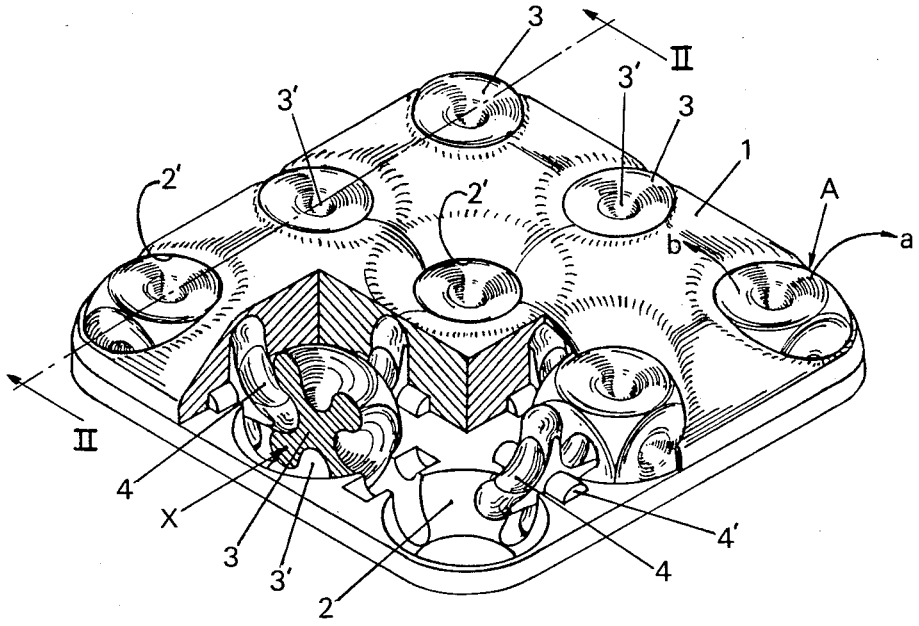

In the example of FIG. 1 each row or column of seats 2 and bodies 3 comprises three of the latter, thus there are two connectors 4 in each row or column.

The connectors 4 may be considered as being sprockets with four teeth which mesh with the bodies 3 by entering the recesses 3', as seen in the cut away portion of FIG. 1. Thus if and whenever one of the bodies 3 is turned manually by a player, the two other bodies 3 in the respective row are taken along and turn in the same direction. So e.g. if the body 3 in the right hand corner of the casing 1 (marked by arrow A) is turned in the direction a, the two bodies 3 in the lowermost row will be taken along and turn simultaneously in the same direction. However, if the same body 3 is turned in the direction b the two bodies 3 in the right hand column of FIG. 1 will be taken along.

The bodies 3 have all six faces thereof distinctively marked, say by colouring or by stripes or any other pattern. As can be seen in FIGS. *3a–3f* there may be different colouring or markings in each game, thus offering different possibilities of solution. FIGS. *3c–3f* illustrate six different solutions, namely, *3a* has $10^7$ possible combinations, *3b* has $1.6\times10^8$ combinations while *3f* has $2.6\times10^{12}$ combinations.

It is the task of a player to turn any one of bodies 3 manually until a certain pattern represented by the markings on all bodies is obtained. Thus if the bodies 3 are marked by different colours or pattern, it may be the task of the player to obtain a pattern at which all bodies exhibit that face which carries the desired pattern. Of course it is possible to pre-establish different rules, e.g. to have each row or column show another pattern or colour. It will be seen that a great variety of patterns would be attainable.

I claim:

1. A plaything of the type referred to in the introductory paragraph above, comprising a casing in which fixed seats are provided for a multiple number of bodies, each of which is movable within its seat by being turned about two of its axes, the said bodies having the shape of cubes with rounded edges and rounded corners, recesses having been made in all six faces of each of said bodies, vicinal bodies being interconnected by cross shaped connectors which have bulbous end portions at the free ends of the cross arms, the said bulbous end portions extending matingly into the said recesses of the said bodies.

2. The plaything claimed in claim 1, characterised by different markings on the different faces of the said bodies.

3. The plaything claimed in claim 2, characterised thereby that the said markings are constituted by different colouring of the said bodies.

4. The plaything claimed in claim 2, characterised thereby that the said markings are geometrical figures.

* * * * *